US006938599B2

(12) United States Patent
Senda et al.

(10) Patent No.: US 6,938,599 B2
(45) Date of Patent: Sep. 6, 2005

(54) ENGINE STARTER HAVING STARTER MOTOR

(75) Inventors: Takashi Senda, Niwa-gun (JP); Masahiko Osada, Okazaki (JP); Tsutomu Nakamura, Kariya (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/780,753

(22) Filed: Feb. 19, 2004

(65) Prior Publication Data

US 2004/0168664 A1 Sep. 2, 2004

(30) Foreign Application Priority Data

| | | |
|---|---|---|
| Feb. 28, 2003 | (JP) | 2003-052182 |
| Mar. 25, 2003 | (JP) | 2003-083010 |
| Dec. 2, 2003 | (JP) | 2003-402701 |

(51) Int. Cl.[7] ..... F02N 11/00
(52) U.S. Cl. ..... 123/179.3; 290/38 R
(58) Field of Search ..... 123/179.3; 290/38 R

(56) References Cited

U.S. PATENT DOCUMENTS

| | | | | |
|---|---|---|---|---|
| 3,596,105 A | * | 7/1971 | Segrest | 290/46 |
| 4,551,630 A | * | 11/1985 | Stahura et al. | 290/38 R |

FOREIGN PATENT DOCUMENTS

| | | |
|---|---|---|
| FR | 2 803 631 | 7/2001 |
| JP | A 3-37373 | 2/1991 |

* cited by examiner

*Primary Examiner*—Andrew M. Dolinar
(74) *Attorney, Agent, or Firm*—Oliff & Berridge, PLC

(57) ABSTRACT

An engine starter includes a starter motor which has an armature, a series-wound field coil and a parallel-wound field coil and a short-circuiting unit for short-circuiting the series-wound field coil under a predetermined engine starting condition. The series-wound field coil has a suitable current limiting resistance. The short-circuiting unit short-circuits the series-wound field coil after a crankshaft of an engine passes a first top dead center of an engine.

13 Claims, 13 Drawing Sheets

ON
OFF

ON
OFF

100%
x%
0%

TDC

ON
OFF

0rpm
TIME

ENGINE STARTER HAVING STARTER MOTOR

CROSS REFERENCE TO RELATED APPLICATION

The present application is based on and claims priority from the following Japanese Patent Applications: 2003-52181, filed Feb. 28, 2003; 2003-83010, filed Mar. 25, 2003; and 2003-402701, filed Dec. 2, 2003; the contents of which are incorporated herein by reference.

BACKGROUND OF THE INVENTION

1. Field of the Invention

The present invention relates to an engine starter having a starter motor that includes a field coil for generating a magnetic field.

2. Description of the Related Art

JP-A-Hei 3-37373 discloses such an engine starter. Usually, a starter motor has a series-wound field coil and a parallel-wound field coil. A control element is connected in series to the parallel-wound field coil to control current supplied to the parallel-wound field coil by a control circuit. When the starter is operated, current supplied by a battery to the starter motor increases according to the time constant of the power supply circuit of the starter motor to rotate the crankshaft of an engine. The amount of the current that is supplied to the starter motor becomes maximum when the crankshaft starts its rotation and, thereafter, gradually becomes smaller due to a counter electromotive force generated in the armature of the starter motor.

Because the amount of current supplied to the starter motor is very large when the crankshaft starts rotation, terminal voltage of the battery becomes very low, so that various electrical accessories of a vehicle may not operate properly.

On the other hand, when the starter is connected to the engine, a pinion of the starter and a ring gear of the engine may make big noises if electric current supplied to the starter motor is too large. Such a large amount of electric current may cause sparks between brushes and a commutator of the starter motor and shorten the life time thereof.

SUMMARY OF THE INVENTION

Therefore, a main object of the invention is to provide an improved engine starter that is free from the above described problems.

Another object of the invention is to provide an engine starter that has a current limiting means for limiting starter current of a starter motor to an amount that gives a torque for the starter to surmount a first top dead center but prevents the battery voltage from excessively decreases.

According to an embodiment of the invention, a starter motor includes a first field coil which has a predetermined current limiting resistance to provide a torque to surmount a first top dead center of an engine and a second field coil by which the starter rotates the engine at a suitable rotation speed. The current limiting means includes a short-circuiting means which short-circuits the first field coil when the starter rotates the engine to surmount a first top dead center. It has been observed that the torque provided by the starter motor to surmount the top dead center at a certain rotation speed necessitates such an amount of the main current as is considerably less than the inrush current. It has been also observed that the starter motor is required to provide a starting torque sufficient to rotate an engine from its standstill state that is much larger than the torque to surmount the top dead center. However, it is not necessary to supply as much current as the inrush current to the starter motor.

Therefore, inrush current of the starter motor can be controlled within a predetermined level so that battery voltage can be prevented from excessively dropping while the starter motor provides a sufficient torque to rotates the engine to surmount a first top dead center. Further, the short-circuiting means short-circuits the first field coil after a crankshaft of an engine passes a first top dead center of the engine. Therefore, power loss caused by the current limiting resistance can be minimized.

Preferably, the short-circuiting means operates according to one of a plurality of conditions which includes an amount of current supplied to the starter motor, a current supply time, an engine rotation speed and an engine rotation angle.

The first field coil may include a plurality of magnetic pole cores and series-connected first coil-sections respectively mounted on the pole cores. The second field coil may be connected in series to the first field coil and may include a plurality of parallel-connected second coil sections respectively mounted on the pole cores. Therefore, the series-connected first coil-sections provides a resistance sufficient to limit starting current of the starter motor, and the parallel-connected second coil-sections provides a low resistance to increase current supplied to the second field coil.

The first field coil may include a parallel circuit of series-connected first coil sections. In such a case, the second field coil includes a plurality of parallel-connected second coil sections respectively connected in series to the first field coil. The first coil section may be formed from a wire having a smaller diameter or more number of turns than the parallel-connected second coil sections. This arrangement also provides a resistance effective to limit the starting current of the starter.

As a modification, the second field coil may include a parallel-wound coil connected in series to the first field coil and in parallel with the armature. Instead, the second field coil may also include a parallel-wound coil connected in parallel with the first field coil and the armature. The second field coil may also be connected in series to the first field coil and in parallel with the armature.

Preferably, the short-circuiting means is constituted of a relay and a control circuit for controlling the relay according to a condition such as an amount of current supplied to the starter motor, a current supply time, an engine rotation speed or an engine rotation angle. The control circuit may change control timing of the relay according to a vehicle condition.

Another object of the invention is to provide an engine starter that is able to start an engine without causing the voltage drop of the battery to be more than 2 volts.

According to another embodiment of the invention, an engine starter includes a power supply line having a main switch, a starter motor having an armature, a series-wound field coil and a parallel-wound field coil, field current control means for controlling field current supplied to the parallel-wound field coil, and voltage-drop control means for controlling voltage drop of the battery within 2 volts when the main switch is closed to supply current to the armature. The starter motor is arranged to have a torque to surmount a first top dead center even when voltage of the battery decreases by 2 volts from its normal voltage.

The voltage-drop control means of above featured engine starter may include a member for limiting current supplied to the armature.

The above voltage-drop control means may further include a short-circuiting relay connected in parallel with the member for limiting current and a relay control means for switching the relay from a turn-off state to a turn-on state when a predetermined condition is assumed.

The above relay control means preferably switches the short-circuiting relay from a turn-off state to a turn-on state when a predetermined time has passed, when engine rotation speed becomes a predetermined level, or when the current supplied to the armature decreases to a set amount.

The above field current control means may supply the parallel-wound field coil with a maximum amount of field current when the engine starter drives the engine and a set amount of field current after the short-circuiting relay is switched from the turn-off state to the turn-on state.

The above field current control means may supply the parallel-wound field coil with a set amount of field current after the current supplied to the armature increases and thereafter decreases.

The above field current control means may supply the parallel-wound field coil with a set amount of field current when the engine continues to rotate after surmounting a first top dead center.

The above field current control means may supply the parallel-wound field coil with a set amount of field current so as to maximize the output power of the starter motor.

The above field current control means may supply the parallel-wound field coil with a set amount of field current so as to keep the voltage of the battery higher than a predetermined level.

The above field current control means may supply the parallel-wound field coil with a set amount of field current so as to keep the rotation speed of the engine higher than a predetermined level.

The above field current control means may supply the parallel-wound field coil with a set amount of field current so as to keep the main current supplied to the armature at a predetermined level.

The above field current control means may supply the parallel-wound field coil with a set amount of field current so that the set amount of field current is changed according to a difference between an actual amount of the main current and the set amount of the main current when the actual amount is detected.

The above field current control means may supply the parallel-wound field coil with a set amount of field current so that the set amount of the field current is changed according to a difference between a predetermined voltage of the battery and an actual voltage of the battery.

The above field current control means may supply the parallel-wound field coil with a set amount of field current so that the set amount of the field current is changed according to a difference between a predetermined rotation speed of the engine and an actual rotation speed of the engine.

The above field current control means may supply the parallel-wound field coil with a set amount of field current so that the starter motor can output a maximum power.

The above field current control means may supply the parallel-wound field coil with a set amount of field current so that the voltage of the battery can be higher than a predetermined voltage.

The set amount of field current is controlled so that the rotation speed of the engine can be kept rotating at a predetermined rotation speed.

The above field current control means may change the set amount of field current and the main current according to an engine starting condition.

The above field current control means may supply the parallel-wound field coil with a set amount of the field current at least when the engine is started by an ignition key.

The above field current control means may supply the parallel-wound field coil with a set amount of the field current so that the engine can rotates at a predetermined rotation speed if an abnormality is detected when the engine is being started.

The above engine starter is further characterized by including means for alarming when the battery voltage drop becomes larger than 2 volts. The above engine starter may be characterized by including means for disabling the means for alarming at a predetermined condition.

The above field current control means may control field current supplied to the parallel-wound field coil according to a change in an engine load so that voltage change can be controlled within 0.3 volts.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

The invention will be described below with reference to the appended drawings.

An engine starter according to the first embodiment will be described with reference to FIGS. 1–3.

Figure 1:
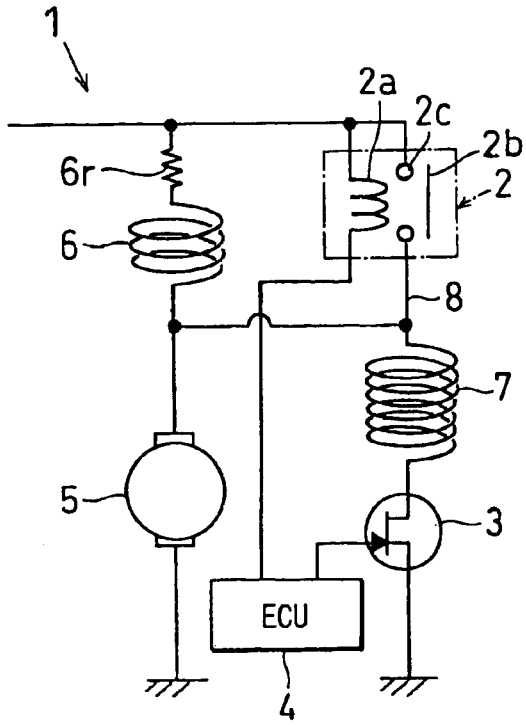
FIG. 1 is a circuit diagram of an engine starter having a starter motor according to the first embodiment of the invention.

As shown in FIG. 1, an engine starter includes a starter motor 1, a relay 2, a control element 3 and a control unit 4. The starter motor 1 includes an armature 5, a series-wound first field coil 6 and a parallel-wound second field coil 7. The first field coil 6 has an internal resistance 6*r* that has about several mΩ or 1.5 through 4 times as many resistances as the internal resistance of a conventional series-wound field coil.

The relay 2 is disposed in a field-coil-short-circuiting circuit 8 that short-circuits the first field coil 6. The relay 2 has a drive coil 2*a*, a movable contact 2*b* and a normally open contact 2*c*. The relay 2 turns on when the drive coil 2*a* is energized and turns off when the drive coil 2*a* is deenergized. The control element 3 is a MOSFET connected in series to the parallel-wound field coil 7. The control unit 4 controls the relay 2 to turn on or off when an engine is started and also controls the control element 3 to change the amount and direction of current supplied to the parallel-wound coil 7.

Figure 2:
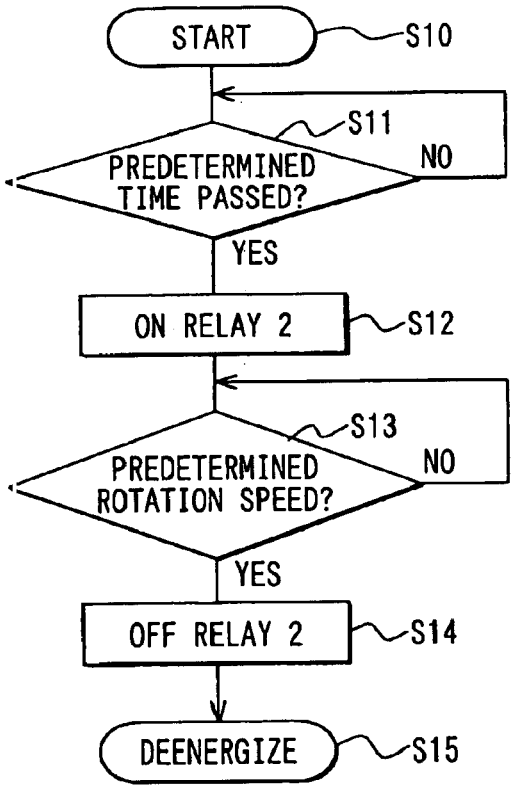
FIG. 2 is a flow diagram of control operation of the engine starter motor shown in FIG. 1.
Figure 3:
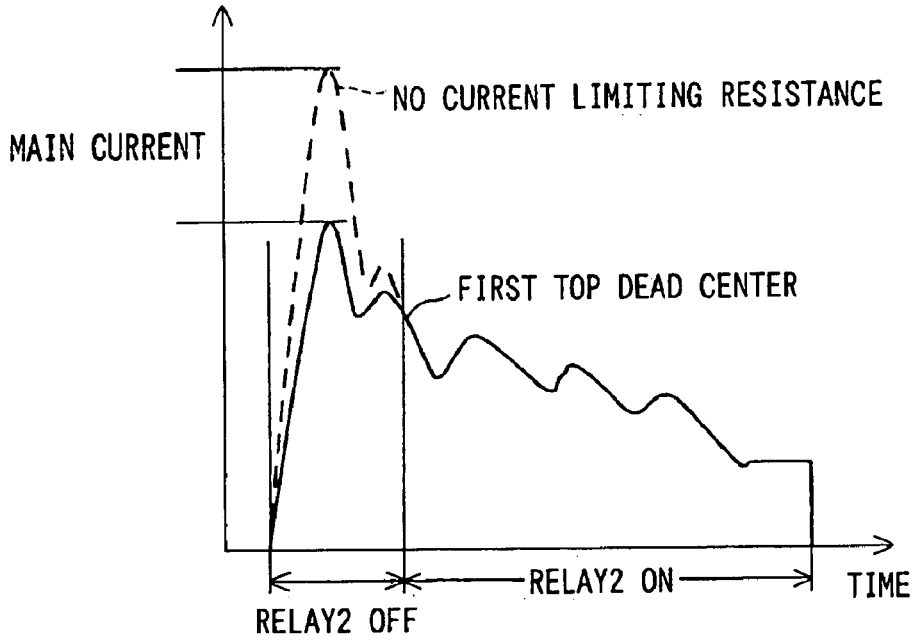
FIG. 3 is a graph showing a characteristic of current supplied to the starter motor shown in FIG. 1.

The control unit 4 controls the relay as in a flow diagram shown in FIG. 2. At first, an engine start signal is inputted at Step 10. Then, whether a predetermine time has passed or not since the starter current is supplied is examined at Step 11. This examination is carried out in order to ensure that the starter rotate the engine past the first top dead center of the engine and that the counter torque of the engine decreases as the rotation speed of the engine increases.

If the result of Step 11 is YES, Step 12 follows to energize the relay coil 2*a*, which brings the movable contact 2*b* from OFF state into ON state so that the first field coil 6 is short-circuited. Therefore, the rotation speed of the starter motor increases to a normal cranking rotation speed. Then, whether rotation speed of the engine increases to a predetermined level (e.g. normal cranking speed) or not is examined at Step 13. This examination is carried out to ensure that the engine is being cranked at a normal cranking rotation speed. If the result is YES, Step 14 follows to deenergize the relay coil 2*a*, so that the movable contact 2*b* is brought from ON state into OFF state, which is the initial state of the starter 1. Finally, the starter motor 1 is stopped at Step 15.

Therefore, the relay 2 is kept turned off after the starter current is supplied to the starter motor 1 until a predetermined time has passed or until the engine surmounts a top dead center thereof. Therefore, the starter current of the starter motor 1 is supplied to the armature through the first field coil 6, the amount of the starter current is limited by the resistance of the first field coil 6, so that the battery voltage is prevented from excessively dropping.

The relay 2 is turned on to short-circuit the first field coil after a predetermined period has passed since the starter motor is supplied with current to let the starter motor 1 to surmount a first top dead center. Therefore, the current supplied to the starter motor 1 of the starter according to the first embodiment of the invention changes in a controlled manner as shown in a solid line in FIG. 3, in which a dotted line shows a characteristic of the starter current of a prior art.

Figure 4:
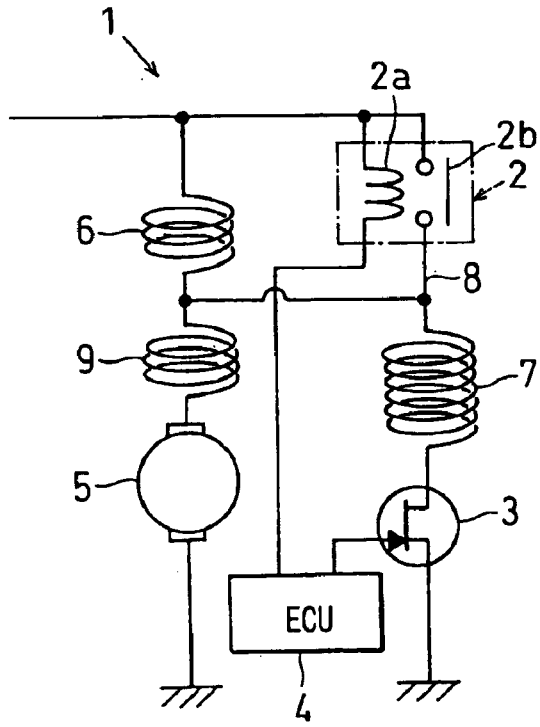
FIG. 4 is a circuit diagram of an engine starter according to the second embodiment of the invention.

An engine starter according to the second embodiment of the invention will be described with reference to FIG. 4. Incidentally, the same reference numeral used in the following embodiments as the previous embodiment represents the same or substantially the same portion, part, component or element as the previous embodiment hereafter.

A starter motor 1 has another series-wound field coil 9 in addition to the components of the starter according to the first embodiment. The additional field coil 9 forms the second field coil with the parallel-wound field coil 7.

The relay 2 is turned off to limit starter current by a resistance of the first field coil until a predetermined time to surmount the first top dead center since the starter motor 1 is supplied with starter current. Thereafter, the relay 2 turns on to short-circuit the first field coil 6, so that the starter motor 1 rotates by the second field coil 7, 9. In this case, current flowing through the additional field coil 9 amounts to amperes of hundreds to increase engine driving torque.

Figure 7:
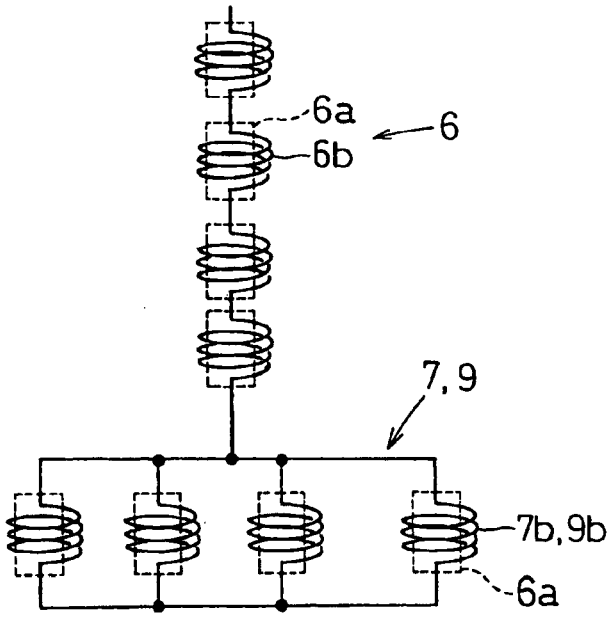
FIG. 7 is a circuit diagram showing an arrangement of field coils of a starter motor of an engine starter according to the fourth embodiment of the invention.
Figure 8:
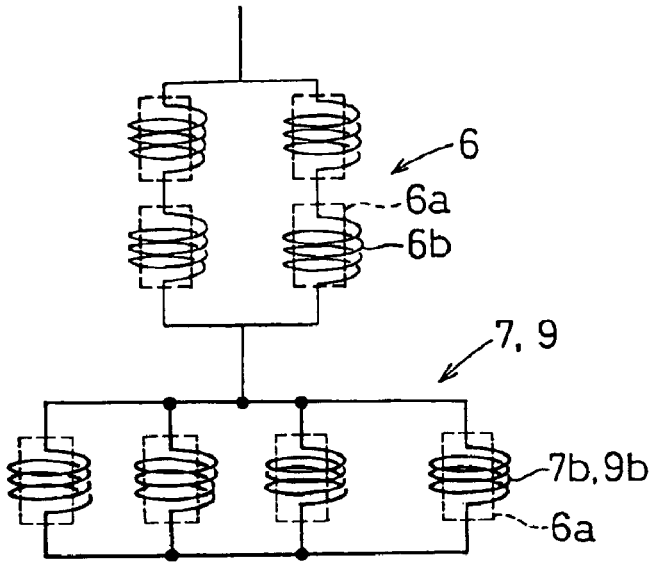
FIG. 8 is a circuit diagram showing a modified arrangement of field coils of a starter motor of an engine starter according to the fourth embodiment of the invention.

If the starter motor 1 has four magnetic poles 6*a*, the first field coil 6 and the additional series-connected field coil 9 are connected as shown in FIG. 7. The first field coil 6 is constituted of series-connected four coil sections 6*b* each of which is mounted on one of the magnetic poles 6*a*. The additional series-wound field coil 9 is constituted of parallel-connected four coil sections 9*b* each of which is mounted on one of the magnetic pole cores 6*a*. The first field coil 6 may be constituted of parallel-connected two pairs of series connected two coil sections 6*b* as shown in FIG. 8. The above arrangements can provide a preferable resistance for limiting the starting current of the starter motor 1 while providing a sufficient driving torque. It is also possible to change the diameter of the magnetic wires of the coils 6, 9 to provide a preferable resistance.

Figure 5:
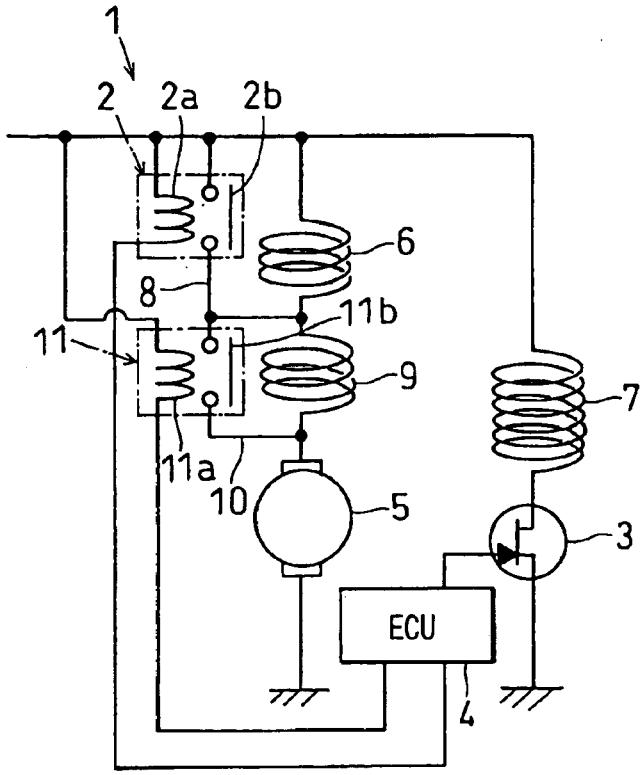
FIG. 5 is a circuit diagram of an engine starter according to the third embodiment of the invention.

An engine starter according to the third embodiment of the invention will be described with reference to FIGS. 5 and 6. In addition to the components of the starter shown in FIG. 4, a short-circuiting circuit 10 and a relay 11 are connected in parallel with the additional field coil 9, as shown in FIG. 5. The relay 11 includes a relay coil 11*a* and a movable contact 11*b*.

Figure 6:
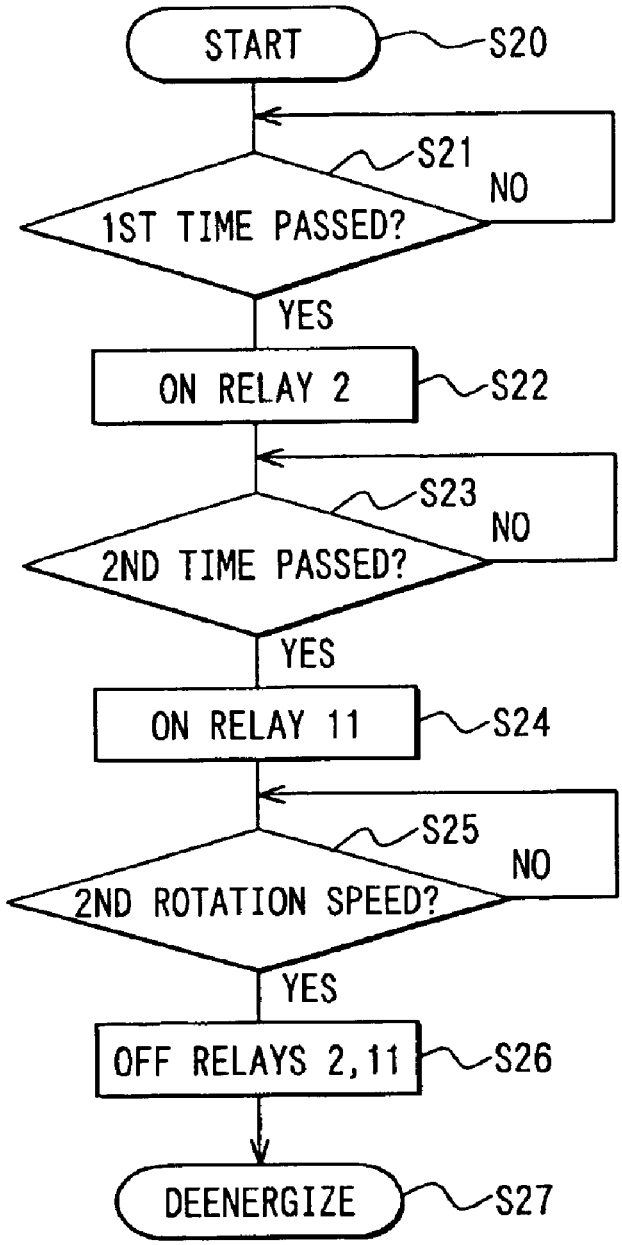
FIG. 6 is a flow diagram of control operation of the engine starter shown in FIG. 5.

In operation, an engine starting signal is inputted at Step 20 at first, as shown in FIG. 6. Then, whether a first predetermined time after the starter motor 1 is energized has passed or not, or whether the engine rotation speed reaches a first predetermined rotation speed or not is examined at Step 21.

If the result of Step 21 is YES, the relay coil 2*a* is energized to move the movable contact 2*b* from OFF state to ON state to short-circuit the first field coil 6 at Step 22. Then, whether a second predetermined time (which is longer than the first predetermined time) is energized has passed or not after the starter motor 1 or whether the starter rotates the crankshaft to surmount the first top dead center or not is examined at Step 23.

If the result of Step 23 is YES, Step 24 follows so that the relay coil 11*a* is energized to move the movable contact 11*b* from OFF state to ON state to short-circuit the additional series-connected field coil 9. Then, whether the engine rotation speed reaches a second predetermined rotation speed (e.g. a normal cranking speed) or not is examined at Step 25.

If the result of Step 25 is YES, Step 26 follows so that the relay coils 2*a*, 11*a* are deenergized to move the movable contact from ON state to OFF state. Finally, the starter motor 1 is deenergized.

Thus, the starting current of the starter motor 1 is supplied to the armature 5 through the first field coil 6 and the additional series-connected coil 9 when two relays 2, 11 are not energized. Therefore, the amount of the starting current is limited by resistances of the coils 6, 9, so that the battery terminal voltage can be prevented from excessively dropping. When two relays are energized, only the parallel-wound field coil 7 provides the magnetic field of the starter motor 1. In this case, the total resistance of the starter motor 1 becomes very low, so that larger torque for cranking can be provided.

An engine starter according to the fourth embodiment will be described with reference to FIGS. 9–11.

Figure 9:
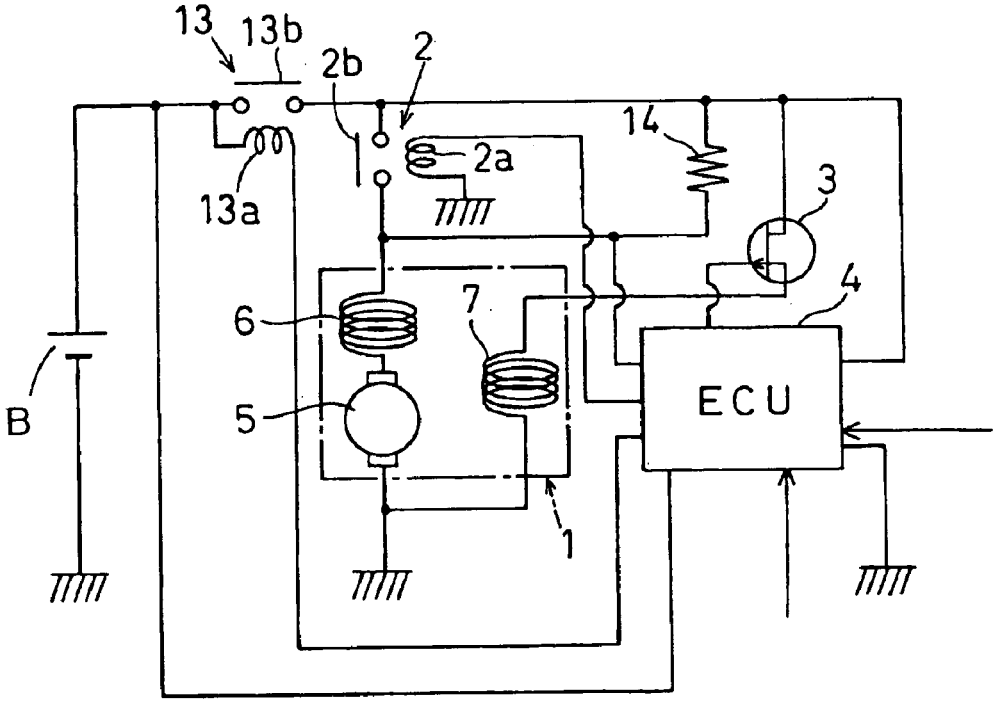
FIG. 9 is a circuit diagram of an engine starter according to the fourth embodiment of the invention.

As shown in FIG. 9, an engine starter includes a starter motor 1, a relay 2, a control element 3, a control circuit (ECU) 4, an electromagnetic switch 13, a starter resistor 14.

The starter motor 1 includes an armature 5, a series-wound first field coil 6 and a parallel-wound second field coil 7. The series-wound first field coil 6 has more turns than the parallel-connected second field coil 7.

The electromagnetic switch 13 is constituted of a coil 13*a* and a movable contact 13*b* and is energized by ECU 4 to close a power circuit of the starter motor 1. The starter resistor 14 is connected between the electromagnetic switch 13 and the first field coil 6 to be in series to armature 5 to limit starting current or inrush current supplied from a battery B so that the voltage drop of the battery B can be limited within 2 volts.

The relay 2 is connected in parallel to the starter resistor 14 between the electromagnetic switch 13 and the first field coil 6 to short-circuit the starter resistor 14 when energized. The relay 2 is disposed in a field-coil-short-circuiting circuit 8 that short-circuits the first field coil 6. The relay 2 has a drive coil 2*a*, a movable contact 2*b* and a normally open contact 2*c*. The relay 2 turns on when the drive coil 2*a* is energized and turns off when the drive coil 2*a* is deenergized.

The control element 3 is a MOSFET connected in series to the parallel-wound field coil 7. The control unit 4 controls the relay 2 to turn on or off when an engine is started and also controls the control element 3 to change the amount of current supplied to the parallel-wound coil 7.

Figure 10:
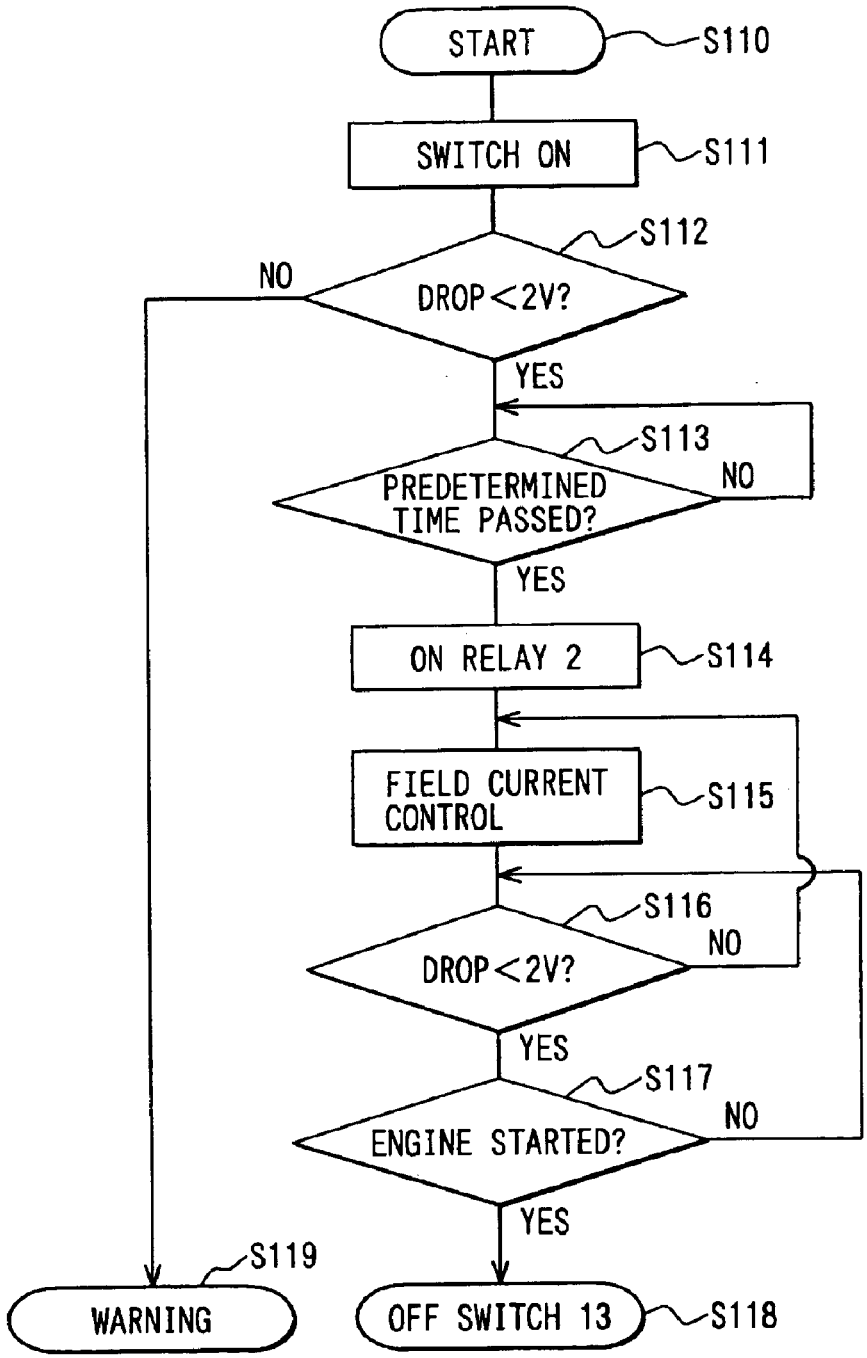
FIG. 10 is a flow diagram of control operation of the engine starter shown in FIG. 9.

When the engine is started, ECU 4 operates as showing in a flow diagram in FIG. 10.

At first Step 110, an engine start signal is inputted to ECU 4. This engine start signal is provided when a key switch is turned on or when an engine mounted in a vehicle equipped with an automatic engine stop-and-start system is restarted after being stopped.

Incidentally, the engine stop-and-start system is a system for a vehicle that automatically stops engine while the vehicle stops in a short time for such a reason as a traffic signal being red, and automatically starts it when the reason disappears, such as change in the traffic signal from red to green.

Then, the electromagnetic switch 13 is turned on at Step 111. Accordingly, starting current is supplied from the battery B to the starter motor 1 via the current limiting resistor 4, so that excessive inrush current can be prevented.

At Step 112, whether the voltage drop of the battery B is less than 2 volts or not is examined, and Step 113 follows if the result of Step 112 is YES. Otherwise, Step 119 follows to give a driver a warning, for example, by a warning lamp.

At Step 113, whether a predetermined time has passed or not after the starter motor 1 is energized is examined to determine a timing to short-circuit the resistor 14. It is also possible to determine the timing by examining the rotation speed of the starter motor 1 or the amount of the current supplied to the starter motor 1. If the result of Step 113 is YES, Step 114 follows. Otherwise, the above examination is repeated until the result becomes YES.

At Step 114, the relay 2 is turned on to short-circuit the current limiting resistor 14. As a result, full voltage of the battery B is applied to the starter motor 1. However, the current supplied to the starter motor 1, which rotates at a speed higher than a predetermined speed, has decreased from its peak. Then at Step 115, current supplied to the parallel-wound second field coil 7 is controlled by control element 3 to increase the rotation speed of the starter motor 1 to a normal cranking speed. Thereafter at Step 116, whether the voltage drop of the battery B is less than 2 volts or not is examined, and Step 117 follows if the result of Step 116 is YES. Otherwise, the step returns to Step 115.

At Step 117, whether the rotation speed of the engine reaches a predetermined level or not is examined to determine start of the engine, and Step 118 follows if the result of Step 117 is YES. Otherwise, the step returns to Step 116 to repeat the examination thereof.

At Step 118, the electromagnetic switch 13 is deenergized to stop supply of the current to the starter motor 1.

The warning made at Step 119 may be disabled when the engine is first started after a long standstill.

Figure 11:
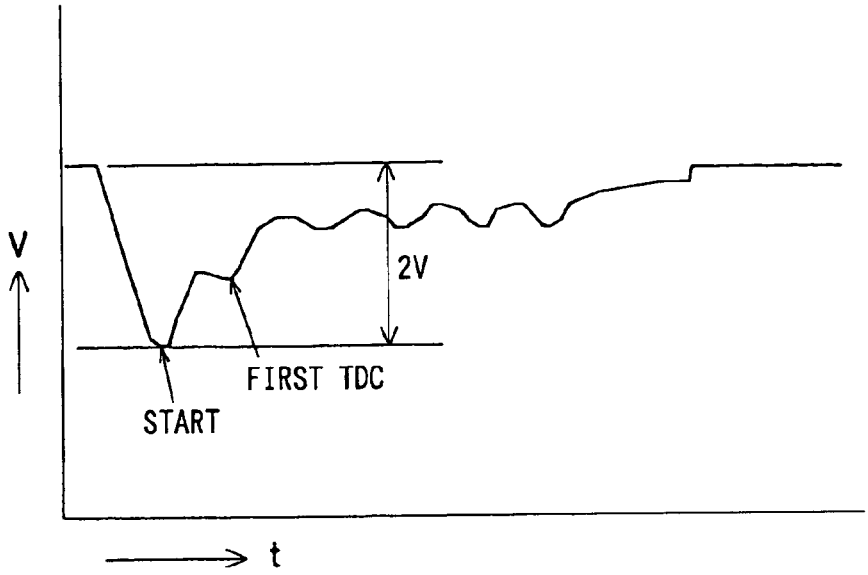
FIG. 11 is a graph showing a battery voltage characteristic when an engine is being started.

Thus, the battery voltage can be controlled within 2 volts, as shown in FIG. 11.

Figure 12:
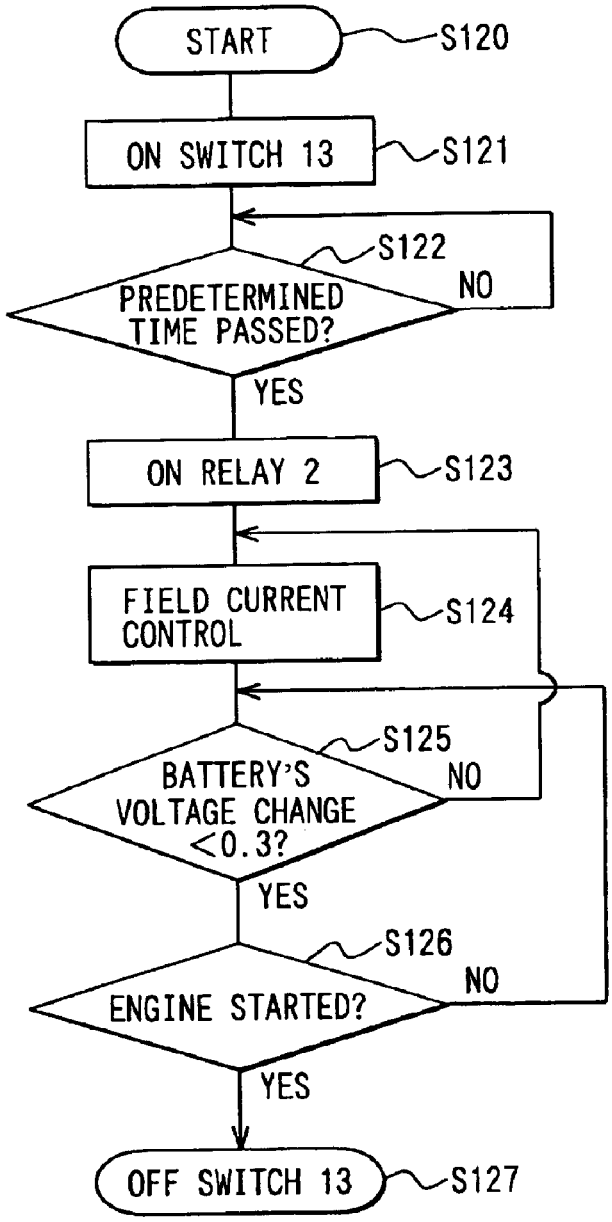
FIG. 12 is a flow diagram of control operation of the engine starter according to the fifth embodiment of the invention.

An engine starter according to the fifth embodiment of the invention will be described with reference to FIGS. 12 and 13.

When the engine is started, ECU 4 operates as shown in a flow diagram in FIG. 10.

At first Step 120, an engine start signal is inputted to ECU 4.

Then, the electromagnetic switch 13 is turned on at Step 121. Accordingly, starting current is supplied from the battery B to the starter motor 1 via the current limiting resistor 4, so that excessive inrush current can be prevented.

At Step 122, whether a predetermined time has passed or not after the starter motor 1 is energized is examined to determine a timing to short-circuit the resistor 14. It is also possible to determine the timing by examining the rotation speed of the starter motor 1 or the amount of the current supplied to the starter motor 1. If the result of Step 122 is YES, Step 123 follows. Otherwise, the above examination is repeated until the result becomes YES.

At Step 123, the relay 2 is turned on to short-circuit the current limiting resistor 14. As a result, full voltage of the battery B is applied to the starter motor 1.

Then at Step 124, current supplied to the parallel-wound second field coil 7 is controlled by control element 3 so that change in the battery voltage can be regulated within 0.3 volts during the engine is being cranked.

Thereafter at Step 125, whether the voltage change of the battery B is less than 0.3 volts or not is examined, and Step 126 follows if the result of Step 125 is YES. Otherwise, the step returns to Step 124 to repeat the examination of Step 125.

At Step 126, whether the engine has been started or not is examined, and Step 127 follows if the result of Step 126 is YES. Otherwise, the step returns to Step 125 to repeat the examination thereof.

At Step 127, the electromagnetic switch 13 is deenergized to stop supply of the current to the starter motor 1.

Figure 13:
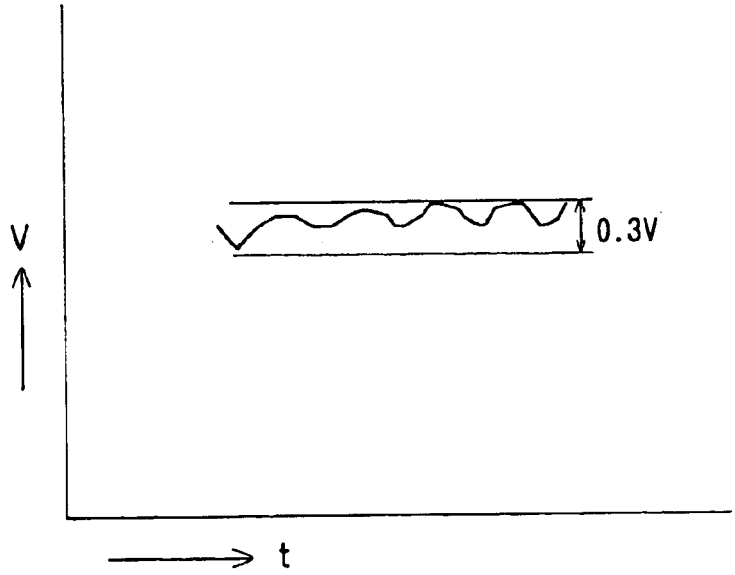
FIG. 13 is a graph showing a battery voltage characteristic when an engine is being cranked.

Thus, the current supplied to the parallel-wound field coil 7 is controlled, so that the change in the battery voltage can be regulated within 0.3 volts, as shown in FIG. 13.

An engine starter according to the sixth embodiment will be described with reference to FIGS. 14-18.

Figure 14:
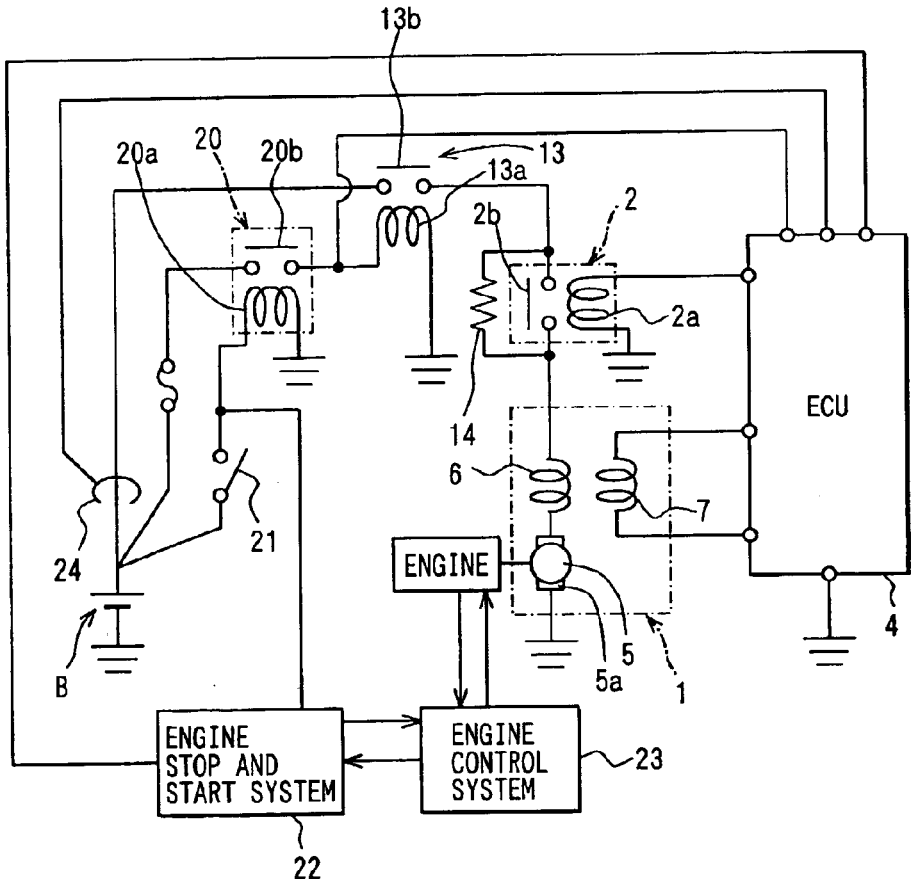
FIG. 14 is a circuit diagram of an engine starter according to the sixth embodiment of the invention.

As shown in FIG. 14, an engine starter includes a starter motor 1 which starts an engine, a relay 2 which short-circuits a starter resistor 14, a control circuit (ECU) 4 for controlling the starter motor 1, an electromagnetic switch 13, a starter relay 20, an ignition key, a control unit 22 of an engine stop and start system, a control unit 23 of an engine control system, etc.

The starter motor 1 includes an armature 5, a commutator 5*a* with a brush unit, a series-wound field coil 6 and a parallel-wound field coil 7. The electromagnetic switch 13 is constituted of a coil 13*a* and a movable contact 13*b*. The electromagnetic switch 13 is connected in series to the starter relay 20 and is energized to close a power circuit of the starter motor 1 when the starter relay 20 is turned on. The starter relay 20 is connected to the battery B via an ignition key 21 and is turned on when the key switch 21 is turned on by a driver. The starter relay 20 has a relay coil 20*a* which is connected to the control unit of the engine stop-and-start system 22. The starter relay 20 is controlled by the engine stop-and-start system 22 while the engine is operated by the engine stop-and-start system 22 via the engine control system 23. For example, if there is a predetermined condition for temporarily stopping engine, the engine stop-and-start system sends the engine control system 23 an engine stop signal (to cut fuel supply or ignition signals).

The starter resistor 14 is connected between the electromagnetic switch 13 and the series-wound field coil to be in series to armature 5 to limit starting current or inrush current supplied from a battery B so that the voltage drop of the battery can be limited within 2 volts if the normal battery voltage is 12 volts.

The relay 2 has a relay coil 2*a* which is controlled by the controller 4 and a normally open contact 2*b* which is connected in parallel to the starter resistor 14 to short-circuit the starter resistor 14 when energized.

The control unit (ECU) 4 includes a relay control circuit for controlling the short-circuiting relay 2 and a field current control circuit for controlling field current supplied to the parallel-wound field coil 7.

The field current control circuit is constituted of a bridge circuit of MOSFETs which control field current by its duty ratio between 0 and 100%.

Figure 15:
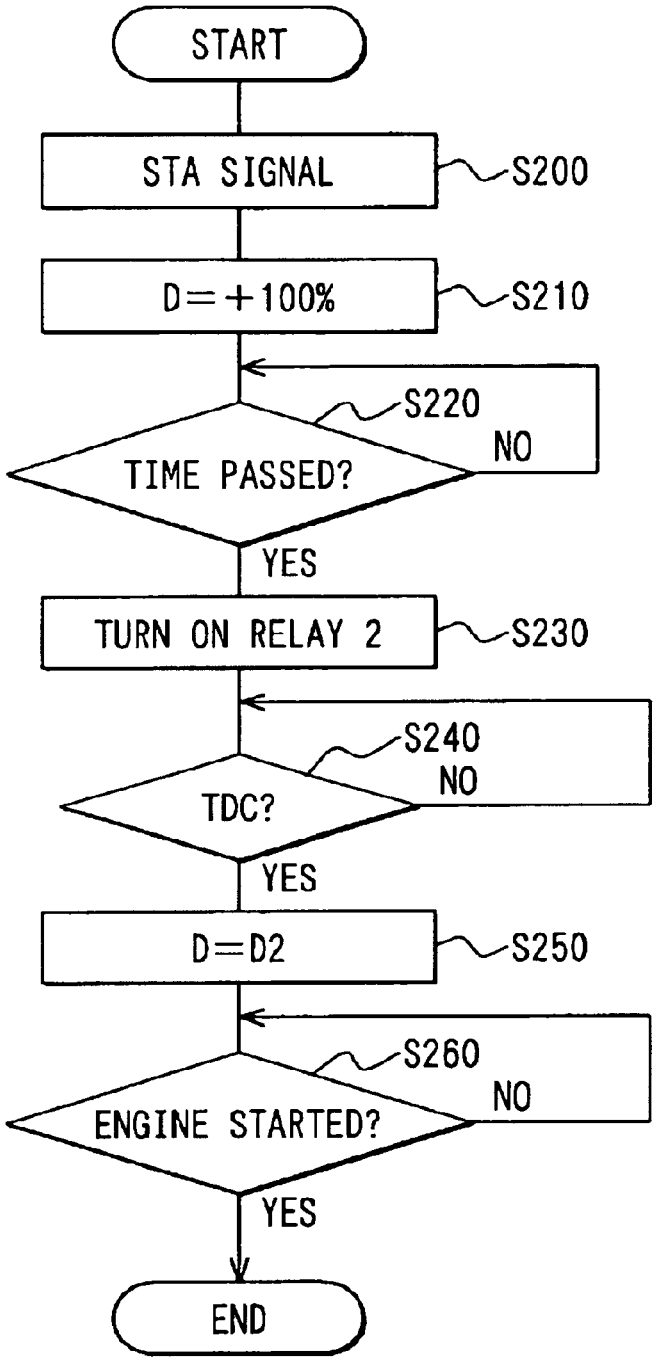
FIG. 15 is a flow diagram of control operation of the engine starter according to the sixth embodiment of the invention.

ECU 4 operates as shown by a flow diagram in FIG. 15 and a time chart shown in FIGS. 16A–16F.

Figures 16A, 16B, 16C, 16D, 16E, 16F:
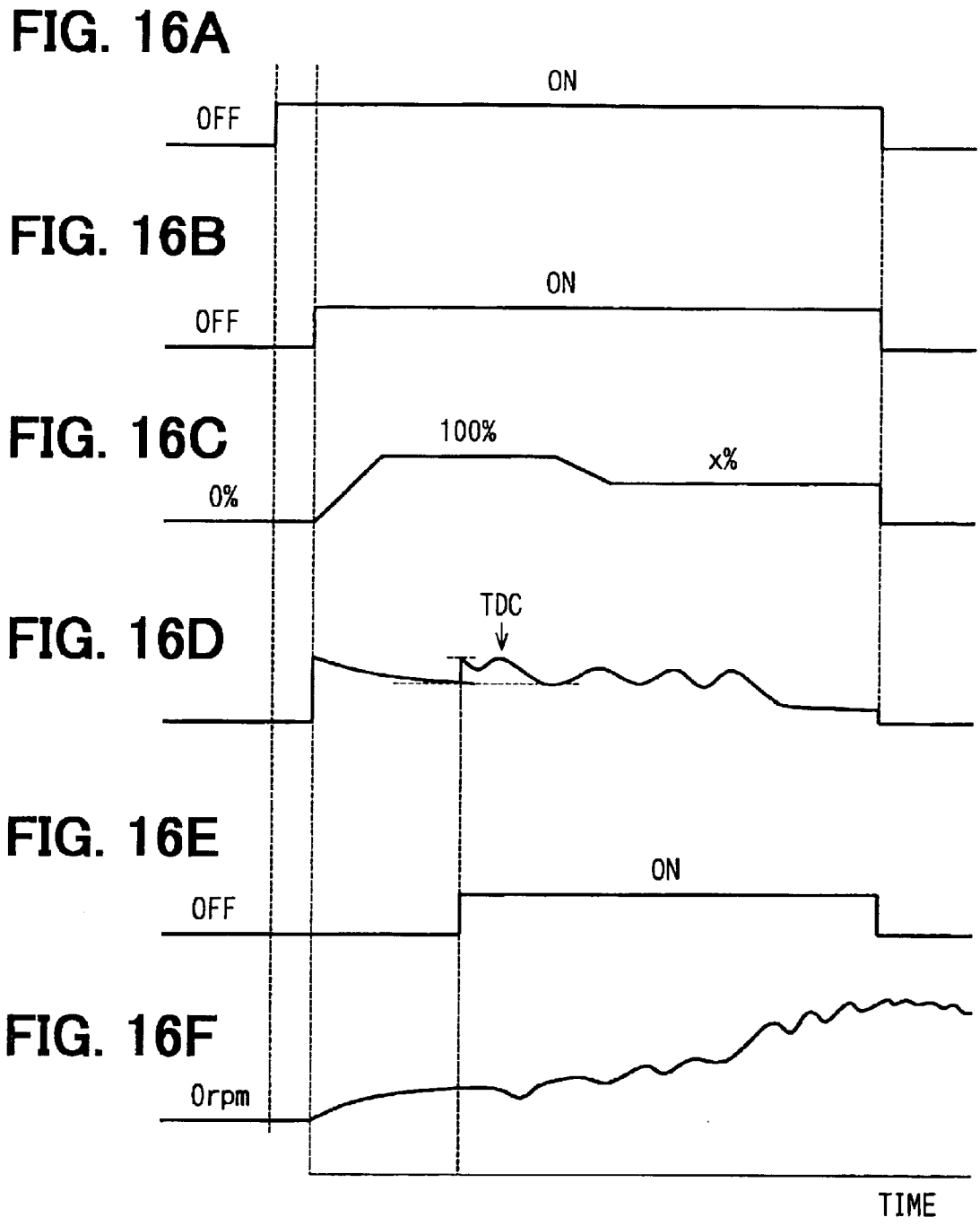
FIGS. 16A, 16B, 16C, 16D, 16E and 16F show a flow diagram of the control operation of the engine starter according to the sixth embodiment.

When the starter relay 20 turns on at such a timing as shown in FIG. 16A, a signal STA is inputted to the ECU 4 at Step 200, as shown in FIG. 16B.

Then, the duty ratio of the field current supplied to the parallel-wound coil 7 is controlled to be 100% at Step 210, as shown in FIG. 16C, so as to provide a sufficient starter torque to surmount the first top dead center.

At Step 220, whether a timing to short-circuit the starter resister 14 is detected or not is examined. For example: (1) whether a predetermined time has passed after the STA signal is inputted or not is examined; (2) whether a predetermined rotation speed of the engine is detected or not is examined; or (3) whether the amount of the main current is less than a predetermined current or not is examined.

Incidentally, the timing can be detected when the armature 5 starts rotation. In this case, when a counter electromotive force is generated, the main current is decreased.

If the result of Step 220 is YES, Step 230 follows. Otherwise, the step returns to Step 220 is repeated until the result becomes YES.

At step 230, the short-circuiting relay 2 turns on to short-circuit the starter resistor 14, as shown in FIG. 16E.

At step 240, whether the first top dead center (TDC) is detected or not is examined. It is possible to detect the first top dead center by detecting a change in the main current supplied to the starter motor instead of directly detecting the first top dead center, because the main current changes as shown in FIG. 16D. If the result of Step 240 is YES, Step 250 follows. Otherwise, Step 240 is repeated until the result becomes YES.

Figure 17:
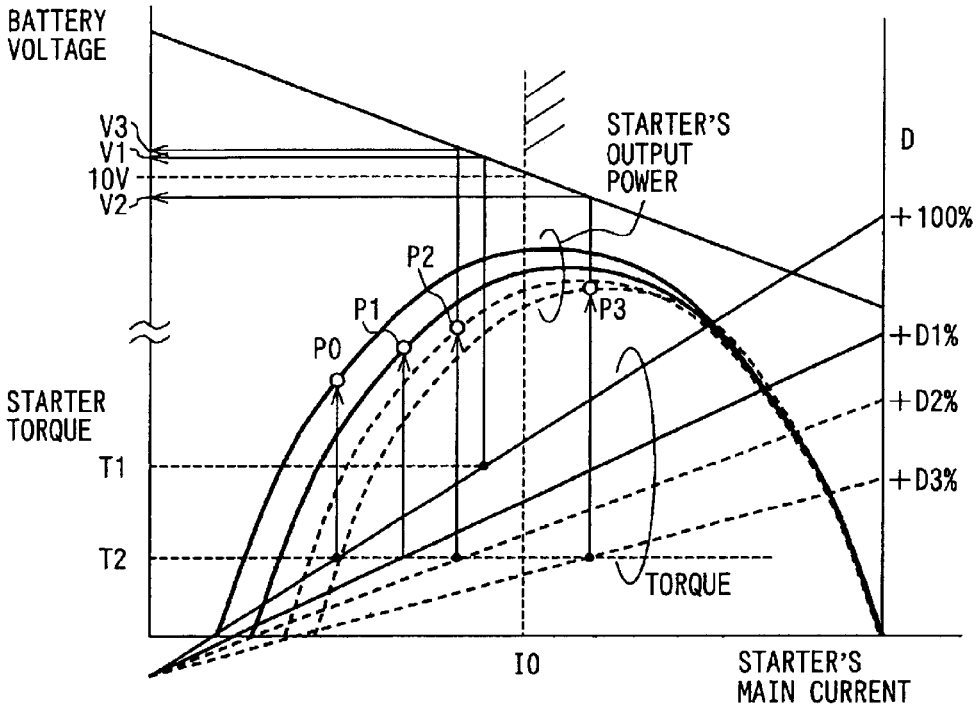
FIG. 17 is a graph showing a characteristic of a starter motor of the engine starter according to the sixth embodiment.

At step 250, the field current supplied to the parallel-wound field coil 7 is controlled so that the duty ratio D can be a predetermined ratio D2. The field current supplied to the parallel-wound field coil 7 is controlled to be its maximum (D=100%) until the starter motor 1 surmounts the first top dead center TDC, where the engine makes the maximum counter torque T1. At that time the battery voltage becomes V1, which is higher than 10 volts, as shown in FIG. 17. After the starter motor 1 surmounts TDC, the counter torque of the engine becomes a cranking torque T2 that is smaller than the maximum counter torque T1. The duty ratio D2 provides a sufficient output power P2 of the starter motor 1 as far as the battery voltage is higher than 10 volts.

This arrangement is very important for a vehicle in which an engine-stop-and-start system is mounted. If the duty ratio remains D1, the starter motor 1 can not output its power sufficiently (P0) or can not operate at a higher speed. On the other hand, the battery voltage becomes lower than 10 volts if the duty ratio is D3 that is smaller than D2, although the starter motor 1 provides its maximum power P3. Accordingly, various vehicle accessories may not properly operate.

At Step 260, whether the engine has started or not is examined. For example, the rotation speed of the engine is detected and compared to a predetermined rotation speed. If the result of Step 260 is YES, the control operation of the ECU 4 ends. If this result is NO, Step 260 is repeated until the result becomes YES.

Figure 18:
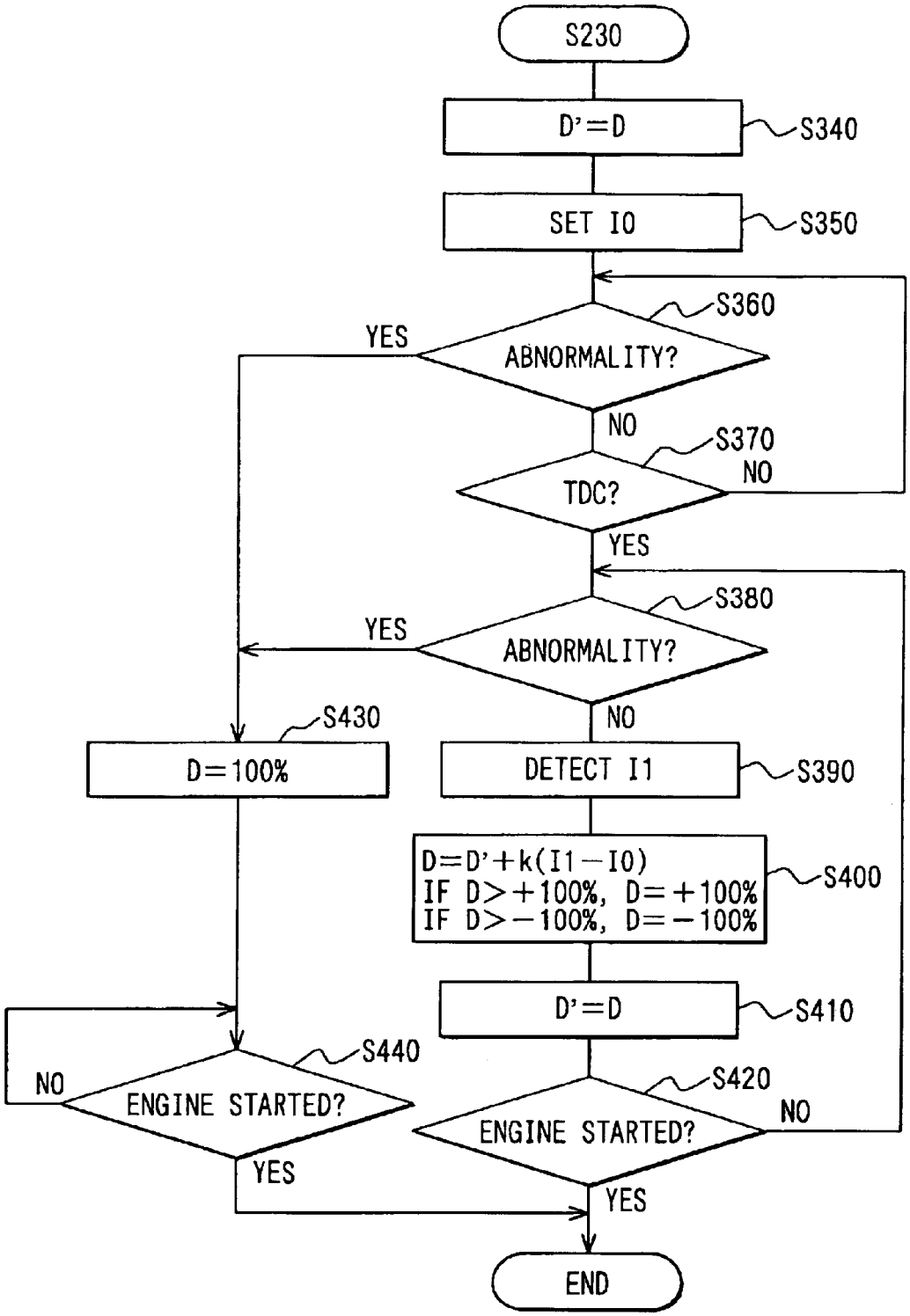
FIG. 18 is a flow diagram setting a predetermined field current of the starter motor of the engine starter according to the sixth embodiment.

The predetermined field current in the above described embodiment is controlled as shown in a flow diagram in FIG. 18.

Step 340 follows after Step 230 in which the duty ratio D' is set to D, (i.e. D'=D).

At Step 350, a predetermined main current IO that sets up a lower limit of the battery voltage, such as 10 volts, and a maximum output power of the starter motor 1.

At Step 360, whether an abnormality is detected or not is examined. If the result of Step 360 is NO, Step 370 follows. On the other hand, Step 430 follows if the result is YES in such a case that the battery B does not provide normal power due to a very cold temperature.

At Step 370, whether the first top dead center (TDC) is detected or not is examined in the same manner as described above. If the result of Step 370 is YES, Step 380 follows. On the other hand, the step returns to Step 360.

At Step 380, an abnormality is further detected. If any abnormality is not detected, NO is provided. Then, Step 390 follows to detect actual main current I1 by the sensor 24 shown in FIG. 14. Otherwise, YES is provided, and Step 430 follows.

At Step 400, the duty ratio D is changed according to the difference between the predetermined main current I0 and the actual main current I1. That is, if an amount of the actual main current I1 is larger than the set amount of the main current I0 (i.e. I1>I0), the duty ratio D of the field current is increased to decrease the actual main current. On the other hand, the duty ratio D is decreased to increase the actual main current if I1<I0. The above feedback control may include a differential function in order to improve the speed of response.

At step 410, the duty ratio D' is set to D, which is set at Step 400.

At Step 420, whether the engine has started or not is examined is the same manner as described above. If the result is YES, the field current control is ended. On the other hand, if the result is NO, the control returns to Step 380.

At Step 430, the duty ratio D is set to 100% so as to start the engine even if an abnormality is detected. At Step 440, whether the engine has started or not is examined, and the control is ended if the result is YES. Otherwise, Step 440 is repeated until the result becomes YES.

Thus, the engine starter maintains its maximum output power during cranking operation of the engine. That is, the engine can be started in a comparatively short time, as shown in FIG. 16F.

Instead of the duty ratio control according to a difference in amount between actual main current and predetermined main current, it is possible to control the duty ratio according to a difference between actual battery voltage and predetermined battery voltage, or a difference between an actual engine rotation speed and a predetermined engine rotation speed.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims.

What is claimed is:

1. An engine starter for rotating a reciprocating engine having a plurality of top dead centers comprising:

a starter motor energized by a battery, said starter motor including an armature, a series-wound first field coil having a predetermined current limiting resistance and a parallel-wound second field coil; and a short-circuiting means for short-circuiting said first field coil after said starter motor rotates the engine to surmount a first top dead center;

wherein said current limiting resistance limits main current supplied to said armature to an amount to provide a sufficient torque of the starter motor to surmount the first top dead center but to prevent terminal voltage of the battery from dropping to a predetermined minimum level.

2. The engine starter according to claim 1, wherein said short-circuiting means short-circuits said first field coil when the main current decreases to a predetermined level.

3. The engine starter according to claim 1, wherein said short-circuit means short-circuits said first field coil when a predetermined time has passed after the main current is supplied to the armature.

4. The engine starter according to claim 1, wherein:

said first field coil comprises a plurality of magnetic pole cores and a plurality of series-connected first coil-sections respectively mounted on said pole cores; and said second field coil comprises a plurality of parallel-wound second coil sections connected in parallel with each other and a series-wound second coil section respectively mounted on said pole cores.

5. The engine starter according to claim 1, wherein:

said first field coil comprises a plurality of magnetic pole cores and a plurality of first coil-sections respectively mounted on said pole cores to form a parallel circuit of said series-connected first coil sections; and said second field coil comprises a plurality of parallel-connected second coil sections respectively mounted on said pole cores and respectively connected in series to said parallel circuit.

6. The engine starter according to claim 4, wherein said first coil-section comprises a wire having a smaller diameter than said plurality of parallel-connected second coil sections.

7. The engine starter according to claim 4, wherein said second field coil is connected in series to said first field coil and in parallel with said armature.

8. The engine starter according to claim 4, wherein said second field coil is connected in parallel with said first field coil and said armature.

9. The engine starter according to claim 1, wherein said second field coil is connected in series to said first field coil and in parallel with said armature.

10. The engine starter according to claim 7, further comprising a control element for controlling current supplied to said parallel-wound coil, wherein said control element is connected in series to said parallel-wound coil.

11. The engine starter according to claim 7, further comprising second short-circuiting means for short-circuiting said series-wound second coil section.

12. The engine starter according to claim 11, wherein said second short-circuiting means comprises a relay and a control circuit for controlling said relay according to one of a plurality of conditions which includes an amount of current supplied to said starter motor, a current supply time, an engine rotation speed and an engine rotation angle.

13. The engine starter according to claim 12, wherein said control circuit changes control timing of said relay according to a vehicle condition.

* * * * *